United States Patent [19]

Hansen et al.

[11] Patent Number: 4,820,406

[45] Date of Patent: Apr. 11, 1989

[54] METHOD FOR THE FROTH FLOTATION OF COAL

[75] Inventors: Robert D. Hansen; Richard R. Klimpel, both of Midland, Mich.

[73] Assignee: The Dow Chemical Company, Midland, Mich.

[21] Appl. No.: 46,357

[22] Filed: May 6, 1987

[51] Int. Cl.[4] ..... B03D 1/02

[52] U.S. Cl. ..... 209/166; 252/61

[58] Field of Search ..... 209/166, 167; 252/61; 44/1 SR

[56] References Cited

U.S. PATENT DOCUMENTS

| | | | |
|---|---|---|---|
| 4,272,364 | 6/1981 | Dixon et al. | 209/166 |
| 4,377,473 | 3/1983 | Laros et al. | 209/166 |
| 4,394,257 | 7/1983 | Wang et al. | 209/166 |
| 4,504,385 | 3/1985 | Keys | 209/166 |
| 4,526,680 | 7/1985 | Owen | 209/166 |
| 4,532,031 | 7/1985 | Wang et al. | 209/166 |
| 4,582,596 | 4/1986 | Hansen et al. | 209/166 |
| 4,589,980 | 5/1986 | Keys | 209/166 |
| 4,606,818 | 8/1986 | Keys | 209/166 |

FOREIGN PATENT DOCUMENTS

| | | | |
|---|---|---|---|
| 1201223 | 2/1986 | Canada . | |
| 2234045 | 1/1973 | Fed. Rep. of Germany . | |
| 512794 | 5/1976 | U.S.S.R. . | |
| 735301 | 5/1980 | U.S.S.R. . | |
| 810285 | 3/1981 | U.S.S.R. . | |
| 810288 | 3/1981 | U.S.S.R. . | |
| 882626 | 11/1981 | U.S.S.R. . | |
| 891158 | 12/1981 | U.S.S.R. . | |
| 914089 | 3/1982 | U.S.S.R. . | |
| 1144728 | 4/1982 | U.S.S.R. | 209/166 |
| 937024 | 6/1982 | U.S.S.R. . | |
| 1045938 | 10/1983 | U.S.S.R. . | |
| 1068435 | 1/1984 | U.S.S.R. . | |
| 1071320 | 2/1984 | U.S.S.R. . | |
| 1077641 | 3/1984 | U.S.S.R. . | |
| 1077643 | 3/1984 | U.S.S.R. . | |
| 1079300 | 3/1984 | U.S.S.R. . | |
| 1082489 | 3/1984 | U.S.S.R. . | |
| 1082490 | 3/1984 | U.S.S.R. . | |
| 1084078 | 4/1984 | U.S.S.R. | 209/166 |
| 1087179 | 4/1984 | U.S.S.R. . | |
| 330688 | 3/1985 | U.S.S.R. . | |
| 2156243 | 10/1985 | United Kingdom . | |
| 2163976 | 3/1986 | United Kingdom | 209/166 |

OTHER PUBLICATIONS

Research Disclosure No. 173,014, (Derwent 70048A/39).

*Primary Examiner*—Kenneth M. Schor
*Assistant Examiner*—Thomas M. Lithgow
*Attorney, Agent, or Firm*—Phillip D. Shepherd; Thomas A. Ladd

[57] ABSTRACT

The froth flotation of coal is conducted in the presence of an epoxide conditioner.

14 Claims, No Drawings

METHOD FOR THE FROTH FLOTATION OF COAL

BACKGROUND OF THE INVENTION

This invention relates to a method for the froth flotation of coal and, particularly, to the use of an oxygen containing compound as a conditioner for coal.

Combustible carbonaceous solid material ("coal") is inherently found in deposits containing non-combustible mineral matter. Although large fragments of the non-combustible materials can be removed by screening or conventional gravity concentration techniques such as centrifugation, froth flotation is more commonly employed to remove the coal from the finer non-combustible materials. In a conventional froth flotation process, a slurry of the coal in an aqueous liquid is separated from non-combustible materials present in the coal ore by introducing a gas (or providing a gas in situ) in the liquid to produce a frothy mass, with the froth containing the coal being recovered and non-combustibles advantageously being maintained suspended (unfrothed) in the slurry.

In the froth flotation process, it is desirable to recover as much coal as possible while effecting the recovery in a selective manner, i.e., minimizing the amounts of undesirable material or ash in the froth. Various flotation agents are used in the frothing process to maximize selective recovery of coal. For example, the froth flotation process is often conducted in the presence of a frother and collector, commonly a hydrocarbon based oil such as kerosene, to enhance the flotation process. The frother assists in maintaining a stable foam and the collector preferentially wets some of the solid particles (e.g., the particles of coal values) which enhances the recovery of the wetted particles and improves the overall flotation process.

A conventional frother used widely in commercial operations is methyl isobutyl carbinol. Many other alcohols are also disclosed as being useful as frothers in a coal flotation process (See, specifically, U.S. Pat. Nos. 4,272,364; 4,377,473; 4,504,385; and 4,582,596).

Many coals, e.g., coals in which the surface has been at least partially oxidized such as sub-bituminous coals, are difficult to float. This results in an undesirable loss of significant amounts of combustible material in the tail from the flotation.

Increases in the amounts of this so-called "hard-to-float" coal recovered in the froth can be improved by increasing the concentration of the oil-type collector employed in the flotation process. Unfortunately, acceptable recovery can often be effected only using such high amounts of the oil-type collector that significant amounts of the non-combustible matter are floated with the coal. Sun suggests in Trans. AIME, 199:396–401 (1954), that fatty amines can be utilized as co-collectors in the flotation of oxidized coals to effect enhanced recovery. However, even these amine collectors float substantial amounts of ash along with the coal and effect only partial recovery of combustible material.

It has also been suggested to employ ethylene oxide, propylene oxide or butylene oxide as a conditioner for the recovery of coal using froth flotation processes. (See, specifically, Russian Pat. No. 810285). Unfortunately, ethylene oxide, propylene oxide and butylene oxide are not particularly effective in enhancing the froth flotation process. This is particularly true when the coal is highly oxidized.

A variety of other materials have been suggested for use to beneficiate coal in a froth flotation process. Such materials include the condensation product of a fatty acid or fatty acid ester with the reaction product of a polyalkylenepolyamine and an alkylene oxide (U.S. Pat. No. 4,305,815); the condensation product of an alkanolamine and a fatty acid or fatty acid ester (U.S. Pat. No. 4,474,619) and the reaction product of the condensation product of diethanolamine and a $C_{10-24}$ fatty acid with a $C_{1-4}$ monocarboxylic acid (U.S. Pat. No. 4,330,339). These materials can be effectively employed in the flotation of coal and are capable of the selective recovery of coal over ash at excellent rates of recovery. However, the fatty acid component of the conditioner is subject to variation in cost. In addition, further improvements in the selectivity of the froth flotation process or in the rate of coal recovery, particularly with highly oxidized coals, are always desirable.

Therefore, it is desirable to provide an alternative method for conditioning or beneficiating coal being recovered in a froth flotation process.

SUMMARY OF THE INVENTION

The present invention is a method for recovering coal using froth flotation. Specifically, the froth flotation method of the present invention comprises the step of floating coal in an aqueous frothing medium containing an effective amount of an oxygen containing compound of the general structural formula:

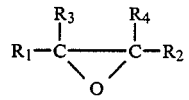

(I)

wherein each $R_1$, $R_2$, $R_3$, and $R_4$ are independently hydrogen, a hydrocarbyl or a substituted hydrocarbyl group provided at least one $R_1$, $R_2$, $R_3$, or $R_4$ is not hydrogen and the total number of carbon atoms in the compound is at least six.

The method of the present invention can be effectively employed to recover coal. It is particularly useful in the recovery of partially oxidized or the so-called "hard-to-float" coals. A relatively high selectivity of coal over ash and other non-combustible materials at excellent rates of recovery can often be obtained.

DETAILED DESCRIPTION OF THE INVENTION

In the present invention, the conditioner of formula (I) (hereinafter referred to as an "epoxide conditioner") is a compound having a total of six or more, advantageously eight or more, more advantageously ten or more, carbon atoms.

Any substituted $R_1$, $R_2$, $R_3$ or $R_4$ group is advantageously substituted with one or more hydroxy, amino, cyano, ether, hydrocarbyloxy or hydrocarbyl thioether groups.

The epoxide conditioners most advantageously employed in the method of the present invention are dependent on a variety of factors including the specific type of coal being recovered, the conditions at which the froth flotation is being conducted (e.g., the types and amounts of frother and collector, if any, employed) and the desired recovery rates. In general, in the epoxide conditioners advantageously employed herein, $R_3$ and $R_4$ are hydrogen and the epoxide conditioner is of the formula:

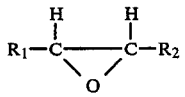

(II)

wherein $R_1$ and $R_2$ are independently an aryl, alkaryl, aralkyl, alkyl, alkenyl, alkynyl, cycloalkyl, cycloalkenyl, $OR_5$ or $SR_5$ group or an aryl, alkaryl, alkyl, aralkyl, alkenyl, alkynyl, cycloalkyl, or cycloalkenyl group substituted with a hydroxy, cyano, $OR_5$ or $SR_5$ group wherein $R_5$ is a hydrocarbyl group of ten or less carbon atoms, preferably an aliphatic or cycloaliphatic, more preferably alkyl, alkenyl, cycloalkyl or cycloalkenyl group. In addition, $R_1$ can be hydrogen or hydroxy and $R_2$ can be an aryl, alkaryl, aralkyl, alkyl, alkenyl, alkynyl, cycloalkyl, cycloalkenyl, $OR_5$ or $SR_5$ group or an aryl, alkaryl, aralkyl, alkyl, alkenyl, alkynyl, cycloalkyl, cycloalkenyl group substituted with a hydroxy, cyano, $OR_5$ or $SR_5$ group.

More advantageously, $R_3$ and $R_4$ are both hydrogen and $R_1$ is hydrogen or an unsubstituted aliphatic, alicyclic or a combination thereof or an aliphatic, alicyclic or combination thereof substituted with one or more hydroxy, $OR_5$ or $SR_5$ group and $R_2$ is unsubstituted aliphatic, alicyclic or a combination thereof or an aliphatic, alicyclic or combination thereof substituted with one or more hydroxy, $OR_5$ or $SR_5$ group(s). Preferably, $R_1$ is hydrogen or a $C_{1-12}$ alkyl or cycloalkyl, more preferably hydrogen or a $C_{1-8}$ alkyl, most preferably hydrogen or a $C_{1-6}$ alkyl and $R_2$ is a $C_{2-20}$, more preferably a $C_{2-18}$, most preferably a $C_{4-18}$, alkyl group.

In general, the most preferred epoxide conditioners are those compounds of formula (II) wherein $R_1$ is hydrogen and $R_2$ is an aliphatic group having from 6 to about 18 carbon atoms more particularly an alkyl group, either straight- or branched-chain, having from 6 to about 18 carbon atoms.

Representative examples of epoxide conditioners which are useful in the practice of the present invention are 1,2-epoxydodecane, 2-ethyl hexyl glycidyl ether, epoxidized castor oil, and t-butyl glycidyl ether. The most preferred epoxide conditioners are 1,2 epoxydodecane and epoxidized castor oil.

The epoxide conditioner is employed in an effective amount. By the term "effective amount", it is meant that the epoxide conditioner is employed in an amount sufficient to improve the froth flotation process as compared to an identical froth flotation process except using no conditioner. The epoxide conditioner is most advantageously employed in an amount which gives the greatest recovery of combustible carbonaceous matter with a tolerable amount of ash and other non-combustible or inert matter. This concentration of epoxide conditioner will vary depending on a variety of factors including the size, rank, degree of oxidation and inert matter content of the coal feed; the specific frother, if any, employed and its concentration as well as the type and concentration of any other materials employed in the froth flotation process; and the specific epoxide conditioner employed. In general, the epoxide conditioner is advantageously employed in an amount of from about 0.001 to about 1.0, preferably about 0.002 to about 0.2, kilograms of epoxide conditioner per metric ton of the coal (dry weight basis) being treated.

The epoxide conditioners can be utilized in conjunction with other conditioners or collectors and other adjuvants such as activators, dispersing reagents, frothers, depressing agents and the like.

A frother is commonly employed in the froth flotation process to promote formation of a froth. Any material capable of promoting the formation of the froth can be employed as a frother herein. Conventionally, frothers are materials containing one or more hydroxyl groups although other materials which are capable of promoting the formation of a froth can also be employed. Representative frothers inolude monohydroxylated compounds such as pine oil, cresol, $C_{4-8}$ alkanols, the reaction product of a $C_{1-6}$ monohydroxy alcohol and propylene oxide or a mixture of propylene oxide and butylene oxide, $C_{1-4}$ alkyl ethers of polypropylene glycols reacted with propylene oxide, terpineol, or methyl isobutyl carbinol; dihydroxylated compounds such as polypropylene glycol; and tri- or higher- hydroxylated compounds such as the reaction product of a $C_{1-20}$ alkane, sucrose, a monosaccharide, disaccharide or a $C_{3-20}$ cycloalkane having three or more hydroxy groups with propylene oxide or a mixture of propylene oxide and ethylene oxide such as described in U.S. patent application No. 646,339, filed Aug. 29, 1984.

Preferred frothers are methyl isobutyl carbinol, polypropylene oxide methyl ethers having a weight average molecular weight between about 200 and about 600 and the reaction product of $C_{4-6}$ alcohols and propylene oxide. The reaction product of a $C_{4-6}$ monohydroxy alcohol and propylene oxide is most preferred.

The amount of frother most advantageously employed in the flotation medium is influenced by a number of factors, most important of which is the rank and degree of oxidation of the coal. Generally, the frother is preferably employed in an amount from about 0.05 to about 0.5 kilogram frother per ton of coal feed (dry weight basis).

A fuel oil collector is also commonly employed in the flotation medium and the froth flotation process of the present invention is preferably conducted using a fuel oil collector or conditioner in combination with the epoxide conditioner. Representative fuel oils include diesel oil, kerosene, Bunker C fuel oil, mixtures thereof and the like. The amount of fuel oil most advantageously employed in the froth flotation is influenced by numerous factors including the size, degree of oxidation and rank of the coal to be floated and the amounts of epoxide conditioner and frother, if any, employed, particularly the amounts of epoxide conditioner employed. The fuel oil is preferably employed in amounts which effect the greatest selectivity and recovery during flotation and such amounts are easily determined by persons skilled in the art. In general, the fuel oil can advantageously be employed in an amount from about 0.01 to about 2.5, preferably from about 0.02 to about 1.5, kilograms fuel oil per metric ton of coal flotation feed (dry weight basis). In one preferred embodiment, the epoxide conditioner is charged to the aqueous flotation medium dispersed in part or all of the fuel oil charge.

In addition, other conditioners such as the condensation product of a fatty acid or fatty acid ester with an alkanolamine such as described in U.S. Pat. No. 4,474,619; the condensation product of a fatty acid or fatty acid ester with the reaction product of a polyalkylenepolyamine and an alkylene oxide such as described in U.S. Pat. No. 4,305,815: the reaction product of the condensation product of diethanolamine and a $C_{10-24}$ fatty acid with a $C_{1-4}$ monocarboxylic acid such as described in U.S. Pat. No. 4,330,339; and the reaction product of naphthenic acid and an alkanolamine such as described in application Ser. No. 888,319, filed July 21, 1986 and aryl sulfonates such as described in U.S. Pat. No. 4,308,133 can be employed. In general, when the epoxide conditioner is employed in combination with another conditioner, the conditioner combination is advantageously employed in an amount from about 0.0001 to about 0.7, preferably from about 0.0002 to about 0.15, kilograms of epoxide conditioner per metric ton of coal flotation feed and from about 0.0003 to about 0.9, preferably from about 0.0004 to about 0.16, kilograms of the other conditioner(s) per metric ton of coal flotation feed.

The process of the present invention can be employed to float anthracite, bituminous, sub-bituminous coal or the like. The process is preferably employed to float coal of intermediate or low rank, particularly bituminous or sub-bituminous coals, where the surface of the coal is oxidized to an extent which significantly impedes the flotation of the coal using a conventional fuel oil collector.

Although coal as large as 10 mesh has been floated using froth flotation processes, in general, the size of the coal particles to be separated by flotation are generally less than about 28 mesh (U.S. Sieve Size). If a substantial fraction of the coal in the flotation feed comprises particles larger than 28 mesh, it is generally desirable that the feed be comminuted further prior to flotation. The weight average particle size of the coal to be floated is generally from about 177 (80 mesh) to about 125 micrometers (120 mesh).

The sized coal flotation feed optionally is first washed and then mixed with sufficient water to prepare an aqueous slurry having a solids concentrate which promotes rapid flotation. Generally, a solids concentration between about 2 to about 20 weight percent solids, more preferably from about 5 to about 12 weight percent, is employed. The aqueous coal slurry is advantageously conditioned with the epoxide conditioner, a fuel oil collector, if employed, and any other adjuvants using methods known to the art. Generally, for difficult to float coal, it is advantageous to contact the coal slurry with the conditioner and fuel oil prior to flotation at conditions which effect intimate contact of the conditioner and fuel oil with substantially all of the coal. In those instances where the aqueous coal slurry is prepared in a container distinct from the flotation cell and then is conveyed to the flotation through conduits, the desired intimate contact can conveniently be attained by introducing the conditioner and fuel oil to the slurry upstream from the flotation cell. Although the frother can be introduced to the slurry during conditioning, it is more preferable to add the frother to the slurry only shortly before flotation or during flotation.

The coal can be floated at the natural pH of the coal in the aqueous slurry, which will conventionally vary from about 3.0 to about 9.5. However, the pH of the aqueous coal slurry is advantageously maintained, prior to and during flotation, at a value from about 4 to about 9, preferably about 4 to about 8, which generally promotes the greatest coal recovery. If the coal is acidic in character, the pH can be adjusted using an alkaline material such as soda ash, lime, ammonia, potassium hydroxide or magnesium hydroxide, with sodium hydroxide being preferred. If the aqueous coal slurry is alkaline in character, a carboxylic acid, such as acetic acid or the like, or a mineral acid, such as sulfuric acid, hydrochloric acid and the like, can be employed to adjust the pH.

The conditioned and pH-adjusted aqueous coal slurry is aerated in a conventional flotation machine or bank of rougher cells to float the coal. Any suitable rougher flotation unit can be employed.

The practice of the process of the instant invention can be used alone to beneficiate coal. Alternatively, the process can be used in conjunction with secondary flotations following the instant process to effect even greater beneficiation of the coal.

The following examples are included to illustrate the invention only and should not be construed to limit its scope. Unless otherwise indicated, all parts and percentages are by weight.

EXAMPLE 1

A 195 gram (g) sample (dry weight basis) of a Republic Banning #4 coal is added to the bottom of an Agitair® type froth flotation cell containing 2800 ml of deionized water to form a 6.5 percent solids slurry. The coal is a highly oxidized, hard-to-float coal and possesses an average particle size such that 96 percent of the coal is less than 45 mesh (350 micrometer).

The coal slurry is agitated at 900 rpm for about six minutes to thoroughly wet the coal. At the end of this period, 0.4 g of a five weight percent solution of 1,2-epoxydodecane in n-dodecane is added to the slurry. This corresponds to adding about 2 kilograms of the conditioner/collector mixture per metric ton of coal (kg/ton). Following the addition of the epoxide conditioner/n-dodecane mixture to the slurry, the slurry is conditioned by agitation for an additional minute. At the end of this time, 0.04 g of a polypropylene oxide methyl ether frother having a weight average molecular weight of 400 sold as Dowfroth® 1012 by The Dow Chemical Company is added to the coal slurry. After the addition of the frother, the slurry is conditioned by agitation for an additional minute. Subsequently, aeration of the slurry is initiated and the froth paddles started. Samples of the frothy concentrate as well as the tailings ("bottoms") are collected at 0.5 minutes and 4 minutes after beginning the froth paddles.

The two samples of the collected concentrate ("heads") and tailings are dewatered using a vacuum filter, dried in a drying oven and then weighed. The ash content of each sample is determined using ASTM test method designated 3174-73 entitled "Standard Method of Test for Ash in the Analysis Sample of Coal and Coke". The fractional clean coal recovery (as determined as the weight of the dried sample less the measured amounts of ash) and fractional ash recovery at 0.5 and 4 minutes are measured and set forth in Table I.

COMPARATIVE EXAMPLE A

A flotation run is conducted in an identical manner to Example 1 except that no epoxide conditioner is employed in the flotation. The fractional clean coal and fractional ash recovery of each sample at 0.5 and 4 minutes is also calculated using the described techniques and is also set forth in Table I.

TABLE I

| Example No. | Conditioner | Fractional Clean Coal Recovery 0.5 min | Fractional Clean Coal Recovery 4 min | Fractional Ash Recovery 0.5 min | Fractional Ash Recovery 4 min. |
|---|---|---|---|---|---|
| A | None | 0.352 | 0.616 | 0.157 | 0.285 |
| 1 | 1,2-epoxy-dodecane | 0.530 | 0.705 | 0.254 | 0.381 |

Based on the foregoing, the fractional clean coal recovery was improved by 14.4 percent when the method of the present invention which employs an epoxide conditioner was compared to an identical method using no conditioner.

EXAMPLE 2

A flotation run is conducted in an identical manner to Example 1 except that 2-ethyl hexyl glycidyl ether is employed in place of the 1,2-epoxydodecane and a purified kerosene sold as Soltrol® 100 (a hydrocarbon collector) is employed in place of the n-dodecane. The fractional clean coal and fractional ash recovery of each sample at 0.5 and 4 minutes is calculated using the described techniques and the results reported in Table II.

EXAMPLE 3

A flotation run is conducted in an identical manner to Example 1 except that an epoxidized castor oil is employed in place of the 1,2-epoxydodecane and a purified kerosene sold as Soltrol® 100 (a hydrocarbon collector) is employed in place of the n-dodecane. The fractional clean coal and fractional ash recovery of each sample at 0.5 and 4 minutes is calculated using the described techniques and the results reported in Table II.

COMPARATIVE EXAMPLE B

A flotation run is conducted in an identical manner to Example 1 except that no epoxide conditioner is employed and a purified kerosene sold as Soltrol® 100 (a hydrocarbon collector) is employed in place of the n-dodecane. The fractional clean coal recovery and fractional ash recovery at 0.5 and 4 minutes is determined and set forth in Table II.

TABLE II

| Example No. | Conditioner | Fractional Clean Coal Recovery 0.5 min. | Fractional Clean Coal Recovery 4 min. | Fractional Ash Recovery 0.5 min | Fractional Ash Recovery 4 min. |
|---|---|---|---|---|---|
| B | None | 0.223 | 0.409 | 0.152 | 0.276 |
| 2 | 2-ethyl hexy glycidyl ether | 0.503 | 0.681 | 0.249 | 0.389 |
| 3 | epoxidized castor oil | 0.669 | 0.774 | 0.341 | 0.438 |

As evidenced by the data set forth in Table II, the flotation method of the present invention which employs an epoxide conditioner provides enhanced recovery of coal relative to flotation systems using no conditioner. Specifically, using a 2-ethyl hexyl glycidyl ether conditioner, the percent increase in fractional clean coal recovery at 4 minutes was increased by 66.5 over the fractional clean coal recovery using no epoxide conitioner. Using epoxidized castor oil as the conditioner, the percent increase in fractional clean coal recovery at 4 minutes was increased by 89.2 over the fractional clean coal recovery using no epoxide conditioner.

EXAMPLE 4

A flotation run is conducted in an identical manner to Example 2 except that the frother is employed in an amount of 0.1 kg/ton of coal and t-butyl glycidyl ether is employed in place of the 2-ethyl hexyl glycidyl ether. The fractional clean coal recovery and fractional ash recovery of each sample at 0.5 and 4 minutes is calculated using the described techniques and the results reported in Table III.

COMPARATIVE EXAMPLE C

A flotation run is conducted in an identical manner to Example 4 except that no epoxide conditioner is employed. The fractional clean coal recovery and fractional ash recovery at 0.5 and 4 minutes is calculated using the described techniques and the results reported in Table III.

COMPARATIVE EXAMPLE D

A flotation run is conducted in an identical manner to Example 4 except that butylene oxide is employed in place of the t-butyl glycidyl ether. The fractional clean coal recovery and fractional ash recovery at 0.5 and 4 minutes is calculated using the described techniques and the results reported in Table III.

TABLE III

| Example No. | Conditioner | Fractional Clean Coal Recovery 0.5 min. | Fractional Clean Coal Recovery 4 min. | Fractional Ash Recovery 0.5 min. | Fractional Ash Recovery 4 min. |
|---|---|---|---|---|---|
| C | None | 0.168 | 0.319 | 0.106 | 0.206 |
| D | butylene oxide | 0.137 | 0.270 | 0.088 | 0.182 |
| 4 | t-butyl glycidyl ether | 0.202 | 0.393 | 0.133 | 0.259 |

As evidenced by the data set forth in Table III, the flotation method of the present invention which employs an epoxide conditioner provides enhanced recovery of coal relative to flotation systems using no conditioner or a method using butylene oxide as a conditioner.

EXMAPLE 5

Using the techniques of Example 1, a sample of a lightly oxidized Conesville coal is recovered by froth flotation using 1,2-epoxydodecane dodecane as a conditioner and an n-dodecane collector. The mixture of conditioner/collector is employed in an amount of 0.5 kg/ton of coal and a frother (Dowfroth® 1012) is employed in an amount of 0.1 kg/ton of coal. The fractional clean coal recovery and the fractional ash recovery at 0.5 and 4 minutes is calculated and the results reported in Table IV.

COMPARATIVE EXAMPLE E

A froth flotation run is conducted in an identical manner to Example 5 except that no epoxide conditioner is employed. The fractional clean coal recovery and the fractional ash recovery of each sample at 0.5 and 4 minutes is calculated and the results reported in Table IV.

TABLE IV

| Example No. | Conditioner | Collector | Fractional Clean Coal Recovery 0.5 min. | Fractional Clean Coal Recovery 4 min. | Fractional Ash Recovery 0.5 min. | Fractional Ash Recovery 4 min. |
|---|---|---|---|---|---|---|
| E | None | n-dodecane | 0.516 | 0.581 | 0.276 | 0.322 |
| 5 | 1,2 epoxy- | n-dodecane | 0.702 | 0.804 | 0.396 | 0.463 |

TABLE IV-continued

| Example No. | Conditioner | Collector | Fractional Clean Coal Recovery 0.5 min. | Fractional Clean Coal Recovery 4 min. | Fractional Ash Recovery 0.5 min. | Fractional Ash Recovery 4 min. |
|---|---|---|---|---|---|---|
| | dodecane | | | | | |

As evidenced by the data set forth in Table IV, the flotation method of the present invention which employs an epoxide conditioner provides enhanced recovery of coal relative to flotation systems using no conditioner.

EXAMPLES 6 AND 7

Using the techniques of Example 1, samples of a lightly oxidized Conesville coal are recovered by froth flotation using the epoxide conditioner and Soltrol TM 100 as a collector. The mixture of conditioner/collector is employed in an amount of 0.5 kg/ton of coal and a frother (Dowfroth ® 1012) is employed in an amount of 0.1 kg/ton of coal. The fractional clean coal recovery and the fractional ash recovery at 0.5 and 4 minutes is calculated and the results reported in Table V.

COMPARATIVE EXAMPLE F

A froth flotation run is conducted in an identical manner to Examples 6 and 7 except that no epoxide conditioner is employed. The fractional clean coal recovery and the fractional ash recovery of each sample at 0.5 and 4 minutes is calculated and the results reported in Table V.

COMPARATIVE EXAMPLE G

Froth flotation is conducted in an identical manner to Example 6 except that butylene oxide is employed as the conditioner. The fractional clean coal recovery and the fractional ash recovery at 0.5 and 4 minutes is calculated and the results reported in Table V.

TABLE V

| Example No. | Conditioner | Collector | Fractional Clean Coal Recovery 0.5 min. | Fractional Clean Coal Recovery 4 min. | Fractional Ash Recovery, % 0.5 min. | Fractional Ash Recovery, % 4 min. |
|---|---|---|---|---|---|---|
| F | None | Soltrol TM 100 | 0.464 | 0.510 | 0.235 | 0,269 |
| G | butylene oxide | Soltrol TM 100 | 0.530 | 0.573 | 0.292 | 0.332 |
| 6 | epoxidized castor oil | Soltrol TM 100 | 0.578 | 0.619 | 0.303 | 0.336 |
| 7 | 2-ethyl hexy glycidyl ether | Soltrol TM 100 | 0.595 | 0.654 | 0.322 | 0.370 |

As evidenced by the data set forth in Table V, the flotation method of the present invention which employs an epoxide conditioner provides enhanced recovery of coal relative to flotation systems using no conditioner or a method using butylene oxide as a conditioner.

What is claimed is:

1. A method for recovering coal using froth flotation comprising the step of floating coal in an aqueous frothing medium containing from about 0.001 kg/metric ton of coal ore calculated on a dry weight basis to about 1.0 kg/metric ton of coal ore calculated on a dry weight basis of an epoxy conditioner compound of the general structural formula:

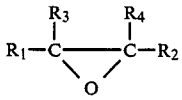

(I)

wherein each $R_1$, $R_2$, $R_3$, and $R_4$ are independently hydrogen, alkyl, aralkyl, alkaryl, aryl or $OR_5$ group or monovalently substituted alkyl, aralkyl, alkaryl, aryl or $OR_5$ group where $R_5$ is a hydrocarbyl group of 10 or less carbon atoms provided at least one $R_1$, $R_2$, $R_3$, or $R_4$ is not hydrogen and the total number of carbon atoms in the compound is at least six but not more than 14 and recovering the coal from the froth.

2. The method of claim 1 wherein the coal ore has an oxidized surface.

3. The method of claim 1 wherein the total number of carbon atoms in the compound is at least eight.

4. The method of claim 3 wherein the compound of formula (I) is 1,2-epoxydodecane, 2-ethyl hexyl glycidyl ether or t-butyl glycidyl ether.

5. The method of claim 1 wherein $R_1$ and $R_2$ are hydrogen and $R_3$ and $R_4$ are independently a $C_{1-11}$ alkyl group.

6. The method of claim 1 wherein the aqueous frothing medium further contains from about 0.02 to about 2.5 kilograms of a fuel oil collector per metric ton of coal ore flotation feed as calculated on a dry weight basis.

7. The method of claim 1 wherein the aqueous frothing medium further comprises a frother.

8. The method of claim 7 wherein the frother is employed in an amount of from about 0.05 to about 0.5 kilogram frother per ton of coal ore feed (dry weight basis).

9. The method of claim 8 wherein the frother is methyl isobutyl carbinol or a polypropylene methyl ether having a weight average molecular weight between about 200 and about 600, or the reaction product of $C_{4-6}$ alcohols and propylene oxide.

10. The method of claim 9 wherein the frother is the reaction product of a $C_{4-6}$ monohydroxy alcohol and propylene oxide.

11. The method of claim 7 wherein the frother is the reaction product of a $C_{1-20}$ alkane, sucrose, a monosaccharide, disaccharide or a $C_{3-20}$ cycloalkane having three or more hydroxy groups with propylene oxide or a mixture of propylene oxide and ethylene oxide.

12. The method of claim 1 wherein $R_1$ and $R_2$ are hydrogen and $R_3$ is a $C_{1-6}$ alkyl, and $R_4$ is a $C_{1-11}$ alkyl.

13. The method of claim 12 wherein the aqueous frothing medium further contains from about 0.01 to about 2.5 kg of a fuel oil collector per metric ton of coal ore as calculated on a dry weight basis.

14. The method of claim 13 wherein the frother is employed in an amount from about 0.05 to about 0.5 kg of frother/ton of coal ore (dry weight basis).

* * * * *